US006533214B1

(12) United States Patent
Guttin

(10) Patent No.: US 6,533,214 B1
(45) Date of Patent: Mar. 18, 2003

(54) DEVICE TO SUPPORT AND DRIVE A WINDING BAR OR TUBE-SHAPED SPINDLE, IN ORDER TO ROLL OR UNROLL BOLTS OF FABRIC

(75) Inventor: Christian Guttin, Les Abrets (FR)

(73) Assignee: Guttin Christian Sarl (FR)

( * ) Notice: Subject to any disclaimer, the term of this patent is extended or adjusted under 35 U.S.C. 154(b) by 0 days.

(21) Appl. No.: 09/557,386

(22) Filed: Apr. 25, 2000

(51) Int. Cl.[7] ..... B65H 75/24

(52) U.S. Cl. ..... 242/571.3; 242/596.5; 242/596.7

(58) Field of Search ..... 242/571.3, 596.5, 242/596.7, 573.4, 571.4, 571.5

(56) References Cited

U.S. PATENT DOCUMENTS

| | | | | |
|---|---|---|---|---|
| 2,524,106 A | * | 10/1950 | Hanson | 242/596.7 |
| 2,908,452 A | * | 10/1959 | Jacobsen | 242/571.3 |
| 3,207,452 A | * | 9/1965 | Haskin et al. | 242/596.5 |
| 4,148,444 A | * | 4/1979 | Hehner | 242/571.3 |
| 4,438,554 A | | 3/1984 | Sciola et al. | |
| 4,479,615 A | | 10/1984 | Nakajima et al. | |
| 4,676,448 A | * | 6/1987 | Kofler | 242/596.5 |
| 4,694,559 A | * | 9/1987 | Lundy et al. | 242/573.4 |
| 4,793,567 A | * | 12/1988 | Weiss et al. | 242/596.7 |
| 4,801,109 A | * | 1/1989 | Hatakeyama et al. | 242/571.3 |
| 4,903,910 A | * | 2/1990 | Tamura | 242/571.3 |

FOREIGN PATENT DOCUMENTS

| | | | |
|---|---|---|---|
| CH | 433397 | 9/1967 | |
| CH | 464965 | 12/1968 | |
| DE | 3432753 | 3/1986 | |
| DE | 3721356 | 1/1989 | |
| DE | 4300389 A1 * | 7/1993 | 242/596.5 |
| EP | 0709327 | 5/1996 | |
| FR | 1539225 | 8/1969 | |
| GB | 317881 | 8/1929 | |
| GB | 925755 | 11/1961 | |

* cited by examiner

*Primary Examiner*—John M. Jillions
(74) *Attorney, Agent, or Firm*—Young & Basile, P.C.

(57) ABSTRACT

A device to support and drive a winding bar or tube-shaped spindle designed to roll or unroll bolts of material of the type containing a guiding bearing and a guided bearing, each made up of a fixed casing in which a shaft can move axially, having an end designed to be able to butt against, at one of its ends which adapted for this purpose, the winding bar or the spindle, the shaft of the guiding bearing being driven to rotation by means of a sleeve rotating in the casing by a motor and the interior of the sleeve can move the shaft axially, all while being linked in rotation while the shaft of the guided bearing is mounted in free rotation. Each fixed casing is in the shape of a cylindrical casing of a jack in the watertight chamber which can move, under action of fluid, a piston attached coaxially to the guiding shaft or to the guided shaft such that the cylindrical casing is equipped at its lower end in a manner that allows extraction of the end of the shaft.

11 Claims, 7 Drawing Sheets

DEVICE TO SUPPORT AND DRIVE A WINDING BAR OR TUBE-SHAPED SPINDLE, IN ORDER TO ROLL OR UNROLL BOLTS OF FABRIC

BACKGROUND OF THE INVENTION

The present invention is a device to support and drive a winding bar or a tube-shaped spindle, in order to roll or unroll bolts of fabric.

One already knows such previous devices which consist of bearings, each containing a rotating shaft in the fixed casing and equipped, at its end, with a seat which has a hollow impression in a non-cylindrical shape complimentary to that of an end of a winding bar which is placed there, as well as a moving piece designed to cover the end in order to support the seat. The winding bar or the model are also mounted, by their ends, in the bearings, the shaft of one of which is capable of being moved in rotation. The mobile piece is generally in the shape of a wheel, capable of tipping over, being moved axially and the maneuvering of which is created manually.

It was proposed to automate the maneuvering of these devices such as that described in document GB925755, to allow the automatic winding of strips of material, rolled or not, on a model in the shape of a hollow axle and able to be measured by the function of the size of these strips. It contains a first bearing and a second bearing, each containing, in a fixed casing, a shaft mobile in axial translation, the shaft of the first bearing being moved into rotation in the casing by a motor. In the interior of the sleeve, the shaft can move axially all the while being linked in rotation while the shaft of the second bearing is mounted in fixed rotation. The end of each shaft has the form of a truncated cone allowing it, from contact under pressure on the end of the corresponding hollow axle, to butt up against the shaft to the first bearing and second bearing and to link the shafts in rotation. Second, the device contains an expanding spindle of the type in such a way that a bobbin containing a model in the shape of a tube, which can be arranged and supported due to the expansion device. The shafts are each moved by means of a mobile piece in the fixed casing by a pneumatic jack located on the exterior of the fixed casing and linked to the end of the rod by means of a small connecting rod to the mobile piece.

All the while, the complex structure of this type of device does not allow easy dismantling of the bearings, which makes maintenance difficult and costly. Also, because of the fact that the mechanical connection between the shaft and the rod of the pneumatic jack is placed outside of the casing, dust enters the interior of the casing, which necessitates frequent dismantling of the bearings for cleaning, augmenting the cost due to the time of maintenance.

It would be desirable to remedy these inconveniences by proposing a device which holds and supports a winding bar or a tube-shaped spindle, in a new arrangement which allows easy and rapid maintenance, and optimization of the rolling and unrolling operations of bolts of material.

SUMMARY

The device to support and drive of a winding bar or tube-shaped spindle according to the invention contains a first bearing and a second bearing, each made up of a fixed casing in which a shaft that can move axially and has an end designed to butt up against one of the ends of the winding bar or the spindle, the shaft of the first bearing being wound in rotation by means of a sleeve rotating in the casing by means of a motor and the inside of the sleeve can move the shaft axially all while being led in rotation, while the shaft of the second bearing is mounted in free rotation and is characterized by each fixed casing being in the form of a cylindrical casing of a jack in the watertight chamber, which can move, under action of a fluid, a piston attached coaxially to the first bearing or the guided shaft and such that the cylinder casing is adjusted at one end in a manner allowing extraction of the end of the shaft.

In accordance with the invention, the piston is attached to a tubular element axially crossed by the shaft, which is mounted in free rotation in the element by means of rollers and attached to the shaft by axial translation, the guide in axial translation in the cylinder casing of the tubular element being maintained by means of sliding, interposed between the internal face of the casing and the external face of the tubular element.

In a preferred method of production, the means of sliding situated adjacent the watertight chamber are made up of a sliding ring wedged in a holding clip fixed to the lower end of the casing between a stop segment housed in a groove made in the internal wall of the cylinder casing and an annular stop closing the lower part of the watertight chamber.

In order to dismantle the bearing, it is sufficient to lift the stop segment and to remove, by the face of one end of all of the shaft, a support clip of the sliding ring, the annular stop, and the tubular element. The assembly and dismantling of the elements of a bearing according to the invention are made, thus, much more quickly and more easily performed than with devices having existing bearings.

The engagement of a winding bar at the ends of the shafts can be created either by association of a projection and an aperture, the shaft of the bearing and the winding bar containing the means of connection in rotation designed to cooperate between them, or by insertion of pins, attached on the perimeter of the face of the end of the shaft or the winding bar in the housings pierced in the face of the bar or respective shafts. The projection and aperture are, preferably, in the shape of a truncated cone or square.

For a truncated cone aperture, the means of connection in rotation consists of the grooves of mesh permitting the linking, in rotation, of the end of the shaft with the end of the winding bar while the two ends are introduced with respect to each other.

In the case of a truncated cone aperture, the aperture will consist of an inner face rounded in such a manner as to facilitate extraction of the corresponding projection.

The square projections will be surrounded by a cylindrical clip in order to form a space between them and the projection designed to tightly receive the face of a corresponding aperture, in order to radially block the projection in the aperture cutting out the play of the existing radials.

The butt joint of the ends of tube-shaped spindle to the ends of the shaft will be produced, preferably, by means of an expandable mechanical head.

The winding shaft can, preferably, contain, at its engagement with the winding bar, an interchangeable tip allowing adaptation of the shafts to all types of winding bars or a tube-shaped spindle, the tip being associated to a means of attachment to the end of the shaft and to the means of connection in rotation with the shaft.

In a preferred method of production, the tip will be of a cylindrical form and will be designed to be introduced in a complimentary structure in the end of the winding bar.

The attachment of the tip in the shaft can be produced, for example, by screwing a screw axially crossing the tip in the bottom of the shaft while the connection in rotation of the tip with the shaft will be able to be produced due to the pins which will be, for example, placed on all or part of the periphery of the face of the shaft in order to engage in the hollow pierced for this purpose in the internal face of the flange.

In the case of engagement with a spindle, the tip is made up of an expandable head by means of a key moving radially against the internal face of the end of the spindle. under the effect of the progress of the shaft.

BRIEF DESCRIPTION OF THE DRAWINGS

The advantages and characteristics of the present invention will become more clear in the description which follows and which relates to the attached drawings, representing a non-limiting method of production in which.

DETAILED DESCRIPTION

Figure 1:
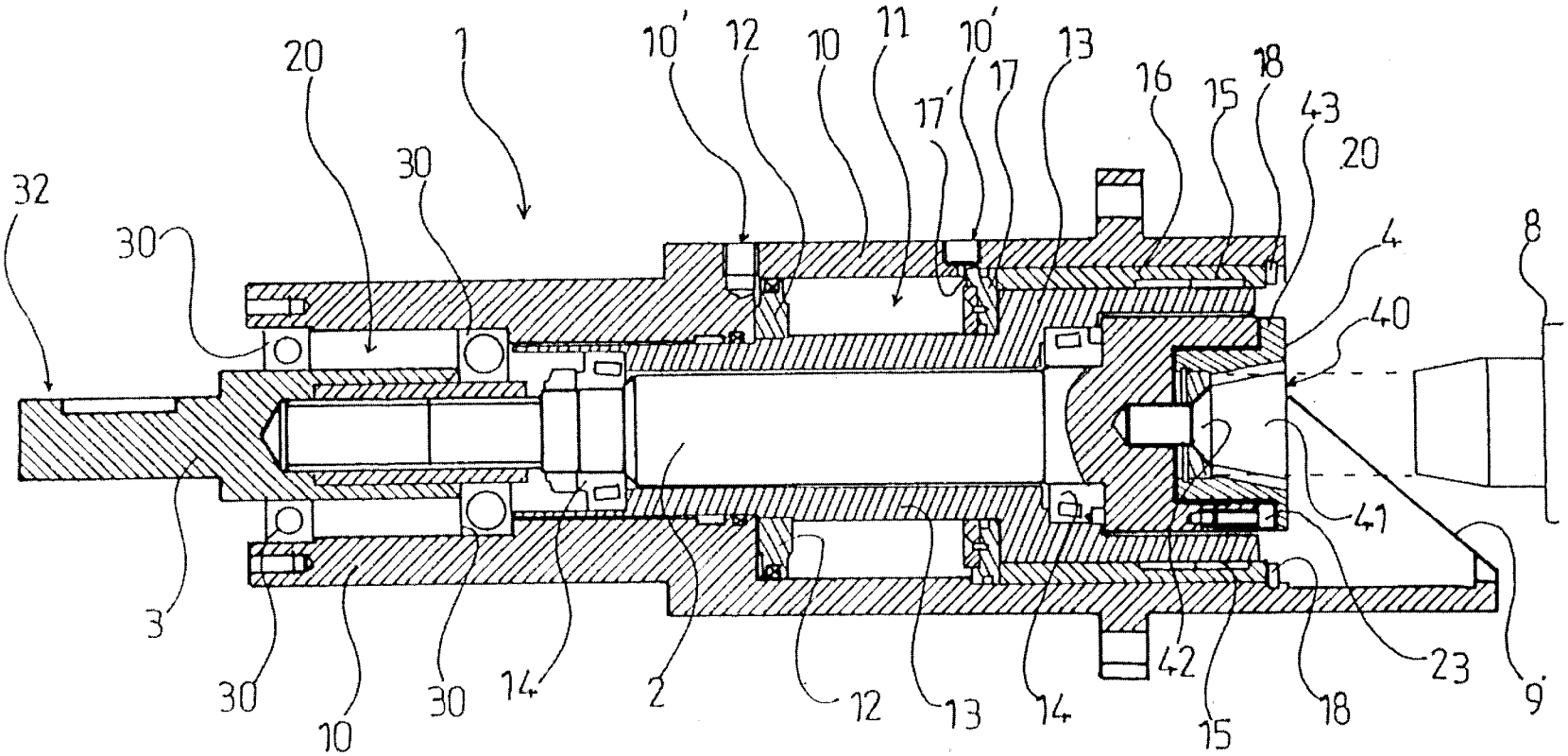
FIG. 1 represents a longitudinally cut, cross sectional view of a fixed casing of a bearing according to the invention.

If one refers to FIG. 1, one can see a bearing 1 containing a casing 10 designed to be fixed onto a stationary support, not represented. The casing 10 is in the shape of a cylinder of a double effect jack casing containing two entrances for fluid, that is to say, that the casing 10 contains a watertight chamber 11 in which a piston 12, attached coaxially to a tubular element 13. can be axially displaced.

Figure 2:
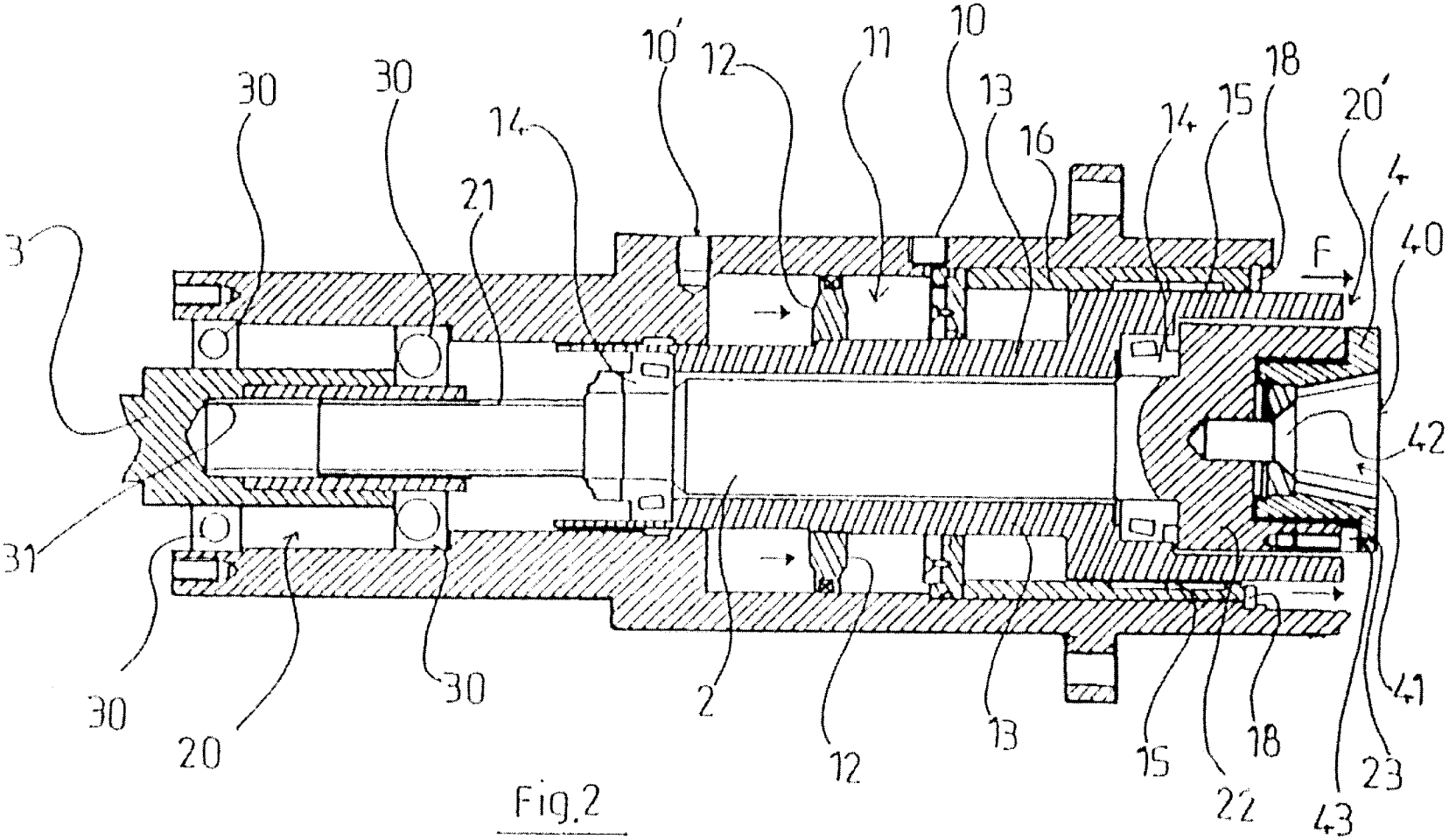
FIG. 2 represents a partial, longitudinally cut, cross-sectional view of the preceding fixed casing with an advanced position of the shaft.

The filling of the chamber 11 from the entrances 10' is performed by the power supply connection, not represented, which has the effect of axially displacing the piston 12 and the tubular element 13, as one can see in FIG. 2, direction F, during the filling of the chamber 10 to the left of the piston 12, and in the opposite direction, during the filling of the chamber 10 to the right of the piston.

The tubular element 13 is axially traversed by a shaft 2 which is carried by rolling clips 14 wedged, at the same time, into the tubular element 13 and onto the shaft 2, such that the shaft is in free rotation in the tubular element 13 and attached to the tubular element 13 in axial translation.

An end 20 of the shaft 2 is cylindrical and is introduced in a sleeve 3, mounted in free rotation in the casing 10 by means of rollers 30 wedged both onto the sleeve 3 and into the casing 10, while the end 20 of the shaft 2 and the sleeve 3 are tied in rotation by means of longitudinal grooves, 21 and 31, respectively, in such a way that the axial translation of the shaft 2 in the casing 10 can be achieved all while supporting the end 20 and the sleeve 3, linked in rotation, as one can see in FIG. 2. Moreover, an end 32 of the sleeve 3, which sticks out from the casing 10, is designed to be paired with a motor, not represented.

An end 20' of the tubular element 13 slides into contact at the end of the casing 10 situated adjacent the chamber by means of an auto-lubricating ring 15 wedged in a clip 16 blocked first between an annular piece 17, crossed by the tubular element 13, and closing, with the element, one part of the chamber 10; while being wedged against a shouldering wall 17' pierced in the casing 10, and second, a stop segment 18 or "circlips" wedged in the casing 10.

The production of the bearing 1, according to the invention, allows, contrary to existing devices, a rapid dismantling by simply lifting the segment 18, thereby freeing the clip 16, the annular piece 17, and the tubular element unit 13, and the shaft 2, by a face of the cylinder casing 10 tip 4 held fixedly in a housing 22 made in a facing of the shaft 2.

One can easily see the end 20' of the shaft 2 equipped with an interchangeable tip 4 held fixedly in a housing 22 made in a facing of the shaft 2.

The tip 4 is of a cylindrical form in the face of an end 40, in which is axially placed aperture 41 in a truncated cone shape designed to receive the complimentary male end of a winding bar 8. The tip 4 is held fixedly in the housing 22 first, axially due to a screw 42 threaded axially in a bottom of the aperture 41 and of the housing 22, and second, in rotation with the shaft 2 by means of pins 23 formed, for example, by the heads of screws screwed on the perimeter of an edge of the end 20' of the shaft 2 and engaged in hollows created for this purpose in the internal face of a flange 43 situated at the end 40 of the tip 4.

One understands that it is easy to change a tip of the shaft 2 by simply unscrewing the screw 42.

Figure 3B:
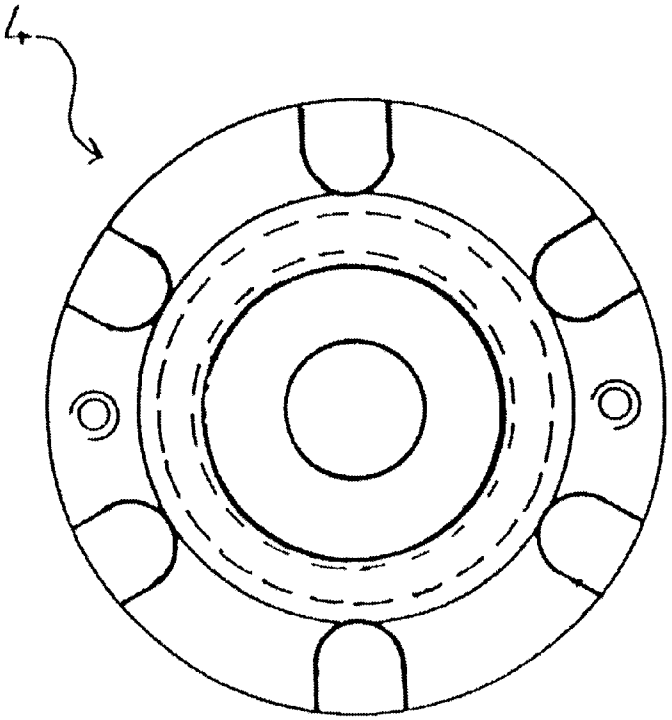
FIG. 3*b* represents a left end view of the tip shown in FIG. 4*a;*
Figure 3A:
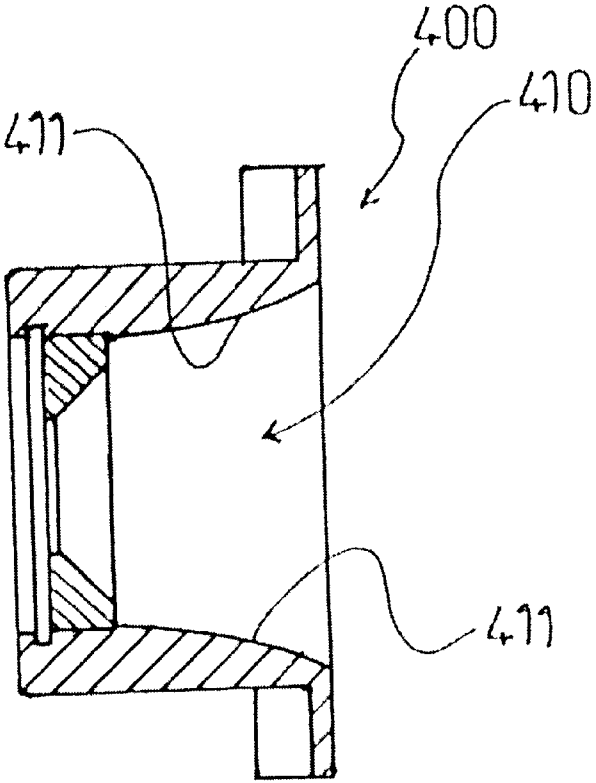
FIG. 3*a* represents a longitudinally cut, cross sectional view of a tip containing an aperture.

Several types of tips 4 can be attached to the end of the shaft 2 such that tip 400, represented in FIGS. 3*a* and 3*b*, contains an aperture 410 in a shape notably that of a truncated cone, but an internal wall 411 of the aperture is rounded in a manner to facilitate the disengagement of the male end, in a conical shape not represented, of the winding bar, the wall of which has only one point of a power surface of the rounded surface.

Figure 4B:
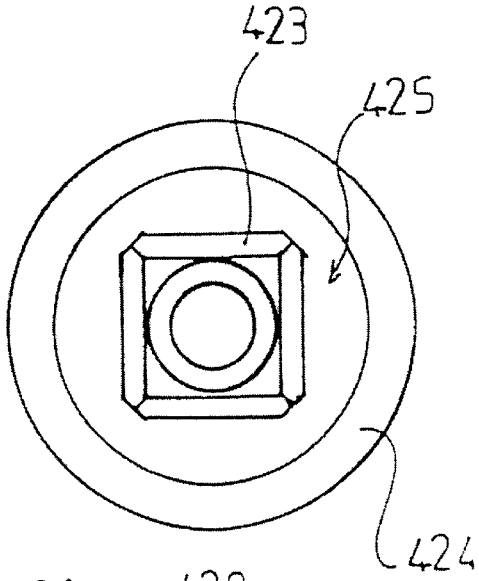
FIG. 4*b* represents a right end view of the tip shown in FIG. 4*a;*
Figure 4A:
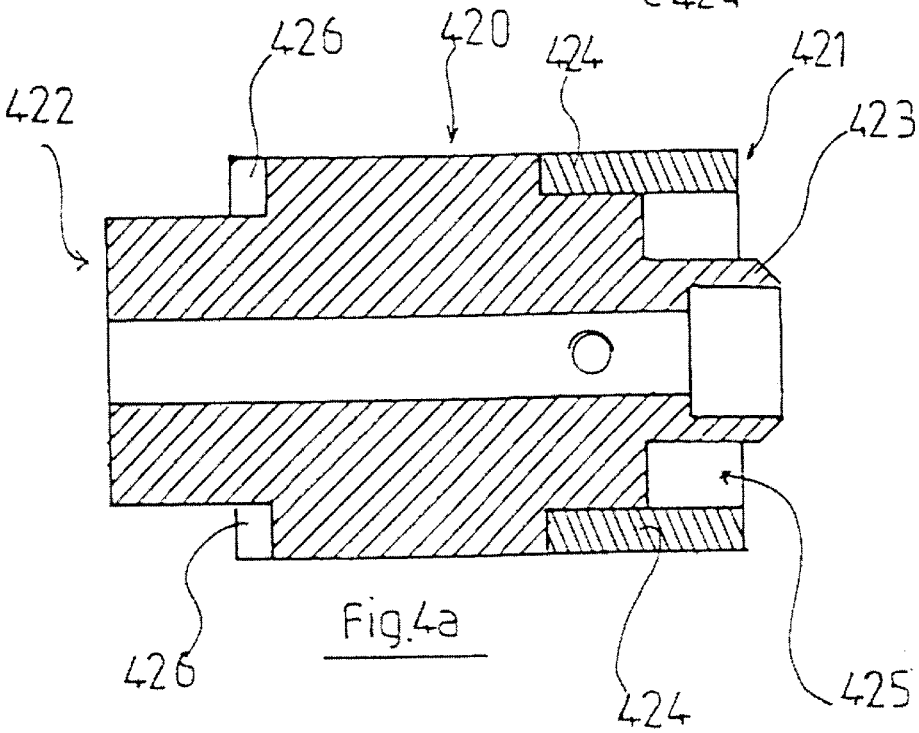
FIG. 4*a* represents a longitudinally cut. cross sectional view of a tip containing a square projection.

FIG. 4*a* shows a tip 420 that is of a cylindrical shape and end 421 of which, opposite to 422 which allows an attachment to a shaft of a bearing, contains a square projection 423 designed to be introduced into a complimentary aperture created in the end of a winding bar. In addition, one can see that a cylindrical clip 424 is attached to the end 421 of the tip 420 surrounding part of the projection 423, in order to create a space 425 allowing the introduction of the bearings, not represented, from the end of the winding bar to block the radial play between the two respective projection and aperture of the tip and the winding bar in the course of their rotation.

Figure 4C:
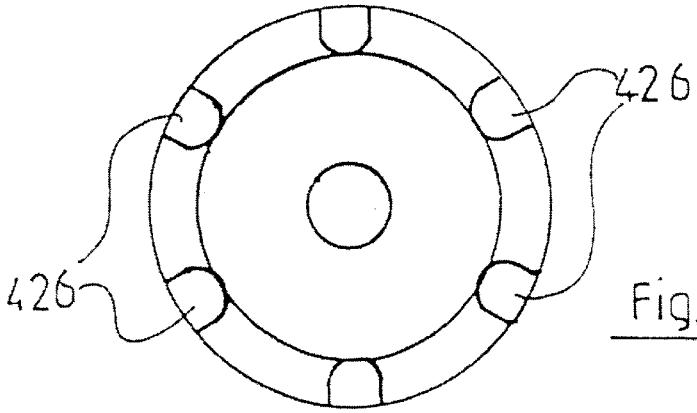
FIG. 4*c* represents left end view of the tip shown in FIG. 4*b;*

One can also see on FIG. 4*c*, a hollow 426 designed to receive pins from the end of the shaft for the rotational connection of the tip 420 with the shaft.

Figure 5A:
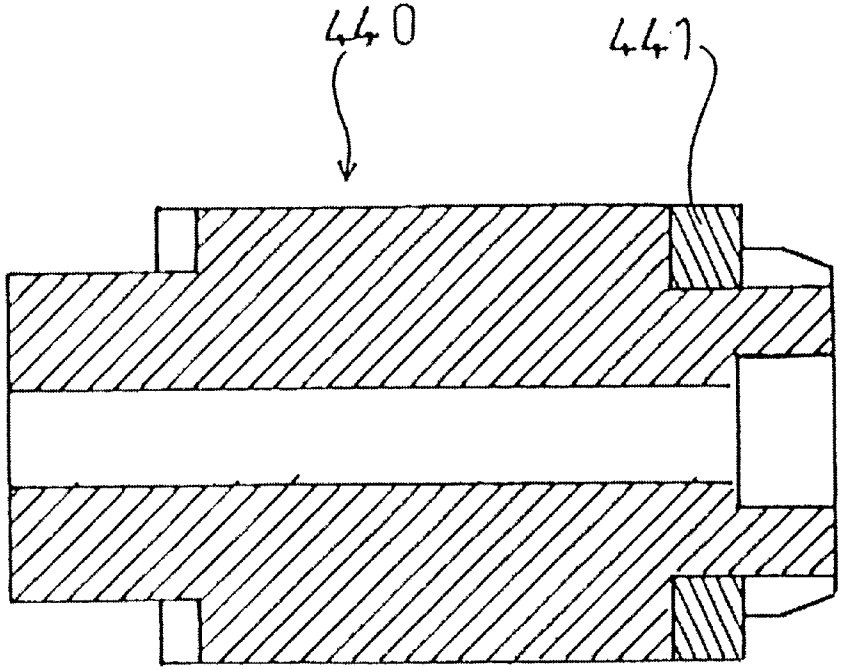
FIG. 5*a* represents a longitudinally cut, cross sectional view of a tip in a particular form of connection in rotation.
Figure 5B:
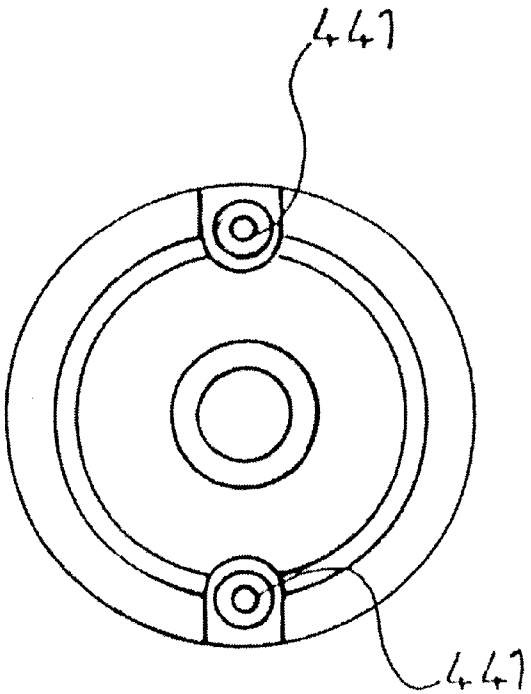
FIG. 5*b* represents a right end view of the tip shown in FIG. 5*a;*

FIGS. 5*a* and 5*b* show a tip 440, the connection of which, at an end of the winding bar, not represented, is created due to two pins 441 placed diametrically opposed from each other and designed to become housed in the hollows created for this purpose at the end of the winding bar to butt up against.

A second bearing, not represented, just like the bearing 1, contains a casing that is in the form of a cylinder casing of a double effect jack, that is to say, containing a watertight chamber, in which a piston can be axially displaced by filling a chamber; a piston attached coaxially to a shaft the free end of the shaft also being equipped with an interchangeable nozzle, but mounted or not in free rotation.

Figure 6:
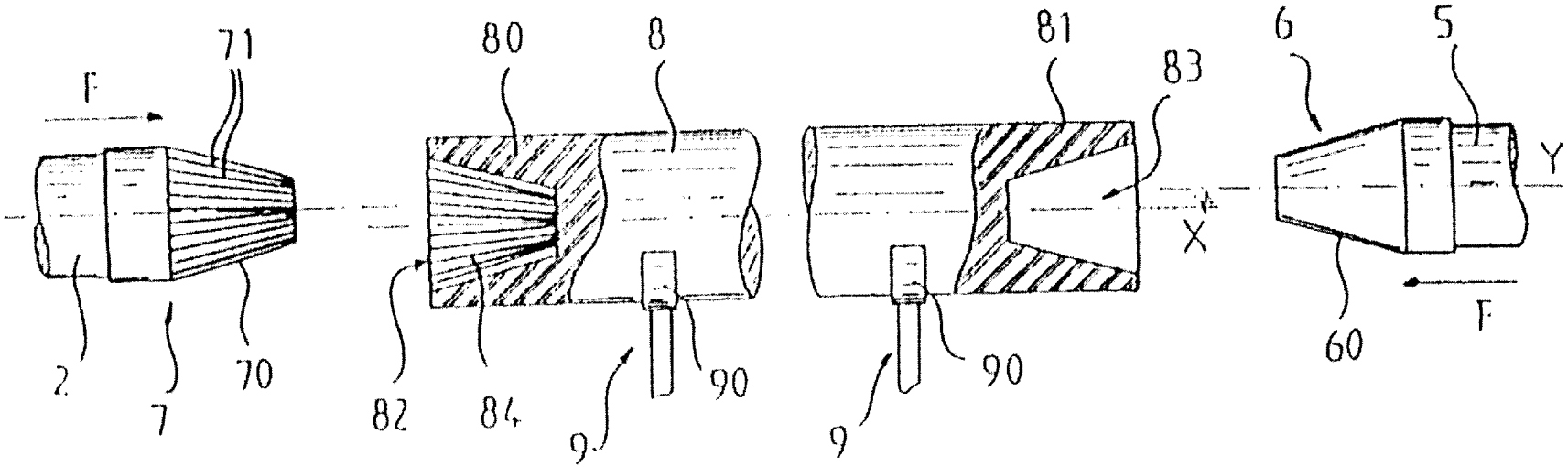
FIG. 6 represents a partially cut schematic view of a winding bar driven into rotation by the conical ends of the shafts of the bearings.

FIG. 6 shows, in a schematic manner, the end 80 of a winding bar 8, so that the tips 6 and 7 are mounted, respectively, on the shaft 2 of a bearing 1, and on the shaft 5 of the second bearing.

The ends 80 and 81 of the winding bar 8 each contain, axially, a apertures, 82 and 83 respectively, in a truncated cone form complimentary with respect to the form of the ends 70 and 60 of the tips 7 and 6.

In addition, the aperture 82 designed to receive the tip 7, presents meshed grooves 84 allowing to tie, in rotation, the tip 7 and the winding bar 8 while the tip 7 is introduced into the aperture 82.

The winding bar 8 is thus designed to be held against the tips 7 and 6 of the shafts, 2 and 5 respectively, which are introduced into the apertures 82 and 83 while the translation in the direction F of the shafts 2 and 5 in the casings 10 by action of pistons, the second bearing, and the bearing 1, not represented.

The placement of the winding bar 8 between the bearing 1 and the second bearing can be achieved in several ways. It can, for example, be grasped by a manipulator arm programmed to lead the axis from the bearing shafts. However, the users of these bearings do not all have access to manipulating arms capable of such a maneuver. It is anticipated that supports 9 of a candle type each contain a cradle 90, on which the winding bar 8 can be set down.

The supports 9 are arranged in a particular manner, in effect, after the placement of the winding bar 8 between the tips 6 and 7, such that the bar 8 need not be in contact with the supports 9. Also the cradles 90 are arranged at a level such that the X-axis of the winding bar 8, at rest, is slightly below the Y-axis of shafts 2 and 5. During the translation of these shafts 2 and 5, the tips 7 and 6 penetrate into the apertures, 82 and 83 respectively, and center themselves there, also provoking, due to the truncated cone shapes of the apertures and projections, the rising of the winding bar 8 and its disengagement of the cradles 90.

One will note the advantageous manner in which the supports 9 can make up an integral part of the bearing 1 and the second bearing, as one can see in FIG. 1 where the fixed casing 10 of the bearing 1 contains at one end, a seat 9' ready to receive the end of the winding bar 8. Like above, the axis of the winding bar 8, while resting, is able to be, advantageously, along an axis spaced apart from that of the Y-axis of the shaft 2.

Figure 7:
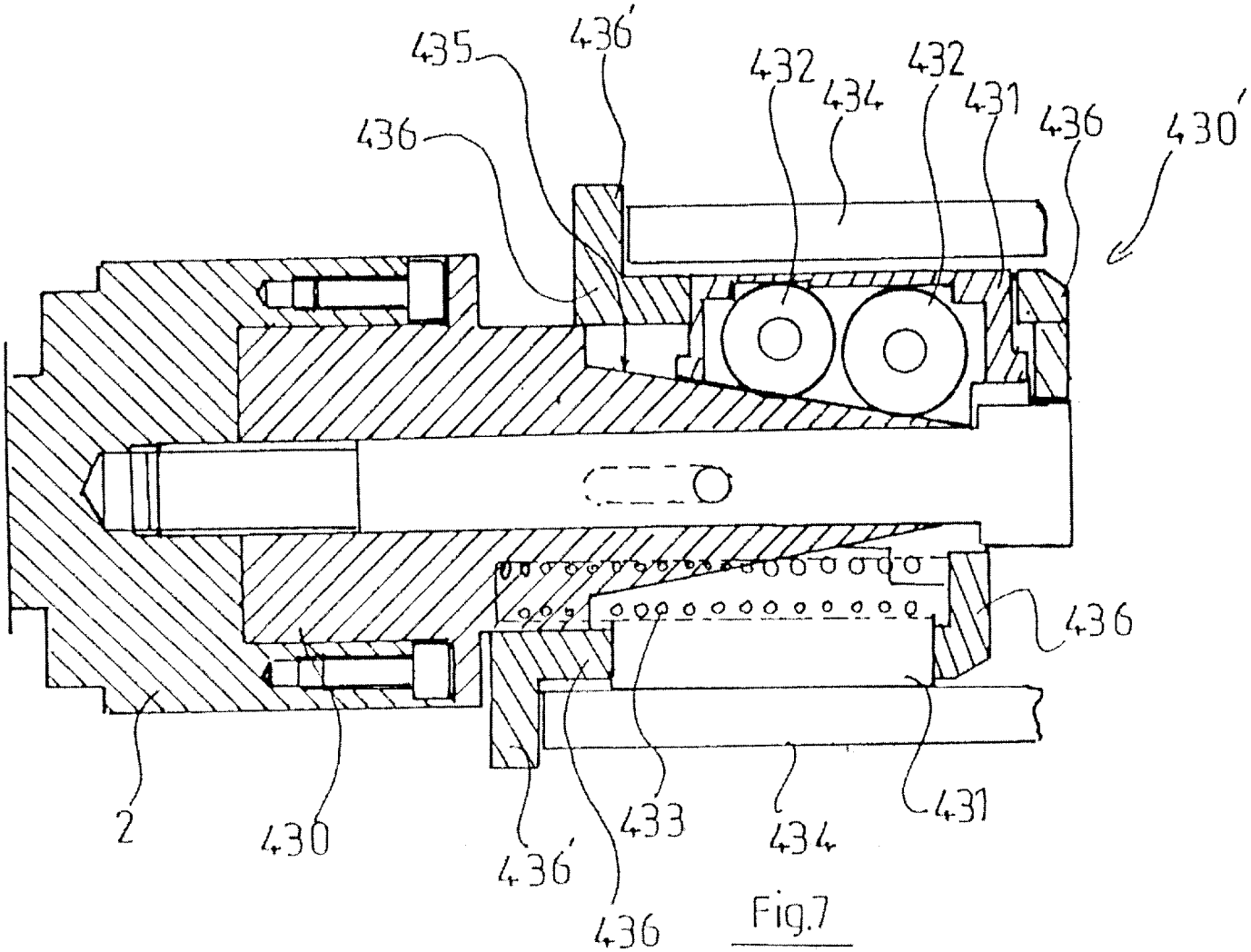
FIG. 7 represents a longitudinally cut, cross sectional view of an expandable tip.

If one now refers to FIG. 7, once can see a tip 430 with an expandable head 430' attached to the end of the shaft 2, as stated in the invention, allowing driving into rotation a tube-shaped spindle 434, and the expandable head 430' of which is tightly inserted in the end of the spindle during the advancement of the shaft 2.

The expansion of the head 430' is achieved mechanically by means of keys 431. The end of the tube 434 pushes against the frontal face of a flange 436' situated behind a piece 436 moving the keys 431 displaced in translation.

So, under the combined effect of the advancement of the shaft 2 and the end of the tube butted up against the piece 436, this piece is moved toward the shaft 2 by winding the keys 431 which then moves, by means of rollers 432, onto a ramp 435, which has the effect of the radial movement of the keys 431 against the internal face of the end of the tube 434 and to link it in rotation with the expandable head 430' and, then, the shaft 2 by the pressure of the contact exerted by the keys 431 on the internal wall of the tube 434.

A spring 433 permits automatically sending of the piece 436 and the keys 431 back to the end of the nozzle in an original position after use.

The present nozzle with an expandable head gives better efficiency than existing nozzles, the heads of which are made expandable due to a rotating crank which causes the movement of the piece that came to push against the internal wall of the end of the model in order to tie it in rotation with the shaft necessitating the unblocking by impractical inverse rotation. Further, the causation of rotation of the crank created by means of a motor making the system more complex than the nozzle according to the present invention.

What is claimed is:

1. A device for supporting a winding bar for the rolling or unrolling of bolts of material comprising:

a guiding bearing made up of a fixed casing in which a shaft can move along an axis of the shaft and is mounted, the shaft having an end created to engage one of the ends of the winding bar, the shaft driven in rotation by means of a sleeve moved in rotation in the casing by a motor, and the interior of the sleeve moves the shaft, the device characterized by said fixed casing having the form of a cylinder casing of a jack in a watertight chamber which can move under fluid action, a piston operably associated with the shaft and wherein the cylindrical casing is arranged at a first end allowing for extraction of the end of the shaft;

the piston being coaxially attached to a tubular element by the shaft which is mounted in free rotation in the tubular element by means of rollers and attached to the tubular element in axial translation, and said piston in the guiding bearing in axial translation in the cylindrical casing of the tubular element and the tubular element supported by sliding means interposed between an internal face of the cylindrical casing and an external face of the tubular element; and the sliding means being made up of a sliding ring wedged in a clip fixedly held at the first end of the cylindrical casing between a stop segment housed in a groove in the internal wall of the cylindrical casing and an annular stop closing a portion of the watertight chamber.

2. The device of claim 1 wherein one of the shaft and the winding bar further comprises a projection and the other includes an aperture, the engagement of the projection and the aperture define a rotatable connection.

3. The device of claim 2 wherein one of the projection and the aperture being in one of the shape of one of a truncated cone and a square.

4. The device of claim 3 wherein one of the projection and the aperture having a truncated cone shape and the rotatable connection including engaging grooves permitting the linkage in rotation of the end of the shaft with the end of the winding bar while the two ends are introduced into each other.

5. The device of claim 3 wherein the aperture further comprises a truncated cone containing an internal wall rounded in a manner to facilitate the extraction of the corresponding projection.

6. The device of claim 3 wherein the projection being square and surrounded by a cylindrical clip creating a space between the clip and the projection designed to tightly receive the corresponding aperture in such a manner to radially block the projection in the aperture.

7. The device of claim 1 wherein the joining of the ends of the winding bar and the shaft being created by means of an expandable head.

8. The device of claim 1 wherein the shaft further comprises:

an interchangeable tip allowing the shaft to adapt to engage with a second winding bar, and by the tip being attached to the end of the shaft and to means of rotatable connection between the shaft and the tip.

9. The device of claim 8 wherein the tip having a cylindrical form and designed to be introduced into a complimentary housing created in the end of the shaft.

10. The device of claim 8 or 9 further comprising:

second means of rotatable connection of the tip and the shaft being pins.

11. The device of claim 8 or 9 wherein the tip further comprises an expandable head and keys which are arranged radially against the internal face of the winding bar to drive the rotation of the tip under the effect of the advancement of the shaft.

* * * * *